United States Patent [19]

Winburn et al.

[11] 4,337,556

[45] Jul. 6, 1982

[54] BURIAL CASKET ASSEMBLY

[75] Inventors: Charles F. Winburn; Wallace P. Blankenship, both of Batesville, Ind.

[73] Assignee: Batesville Casket Company, Inc., Batesville, Ind.

[21] Appl. No.: 202,307

[22] Filed: Oct. 30, 1980

[51] Int. Cl.[3] ..... A61G 17/00

[52] U.S. Cl. ..... 27/2; 27/35

[58] Field of Search ..... 27/2–7, 27/16, 35, 19

[56] References Cited

U.S. PATENT DOCUMENTS

| | | | |
|---|---|---|---|
| 609,262 | 8/1898 | Blackford | 27/16 |
| 951,944 | 3/1910 | Farnam | 27/16 |
| 1,289,990 | 12/1918 | White | 27/16 |
| 1,345,451 | 7/1920 | Lundberg | 27/16 |
| 1,821,760 | 9/1931 | Leitch et al. | 27/35 |
| 2,289,406 | 7/1942 | Beranek | 27/35 |
| 3,050,818 | 8/1962 | Phillips | 27/35 |
| 3,133,334 | 5/1964 | Johnsen | 27/27 |
| 3,613,189 | 10/1971 | Kirby | 27/25 |
| 3,810,282 | 5/1974 | Doggett | 27/35 |
| 3,815,185 | 6/1974 | Owens | 27/3 |
| 4,139,929 | 2/1979 | Angermann | 27/35 |
| 4,177,543 | 12/1979 | Angermann | 27/35 |

FOREIGN PATENT DOCUMENTS 232457 8/1961 Australia .

*Primary Examiner*—John D. Yasko

*Attorney, Agent, or Firm*—Burns, Doane, Swecker & Mathis

[57] ABSTRACT

A burial casket assembly comprises a decorative casket, an insert casket, a base, and a vault cover. The decorative casket receives the insert casket and comprises a decorative container and a decorative cover. The insert casket comprises an insert casket and an insert cover. The decorative casket is supported on the base, and the vault cover is placeable upon the base to encase the decorative casket. The decorative cover is arranged to bear against the insert cover so that when the former is tightened-down, it urges the latter into sealing relationship against the insert container. A hinge arrangement is provided for the decorative casket which enables the cover of the decorative casket to be swung open to either side or completely removed from the decorative container. The floor of the insert container is itself profiled to support the deceased in the traditional posture of repose.

25 Claims, 13 Drawing Figures

BURIAL CASKET ASSEMBLY

BACKGROUND AND OBJECTS OF THE INVENTION

The present invention relates to burial caskets.

Traditionally, a deceased is interred within a burial casket which is of a decorative nature and which may be "sealable" in the sense of creating an air tight seal around the interior compartment to protect the remains of the deceased against the intrusion of air, water, or other outside elements.

It has heretofore been proposed to provide a casket assembly which comprises an insert casket within a decorative shell, whereby the deceased is sealed within the insert casket and buried separately of the shell, the latter functioning merely as a decorative overlay for the insert casket during the funeral services. In this regard, attention is directed to U.S. Pat. Nos. 1,821,760; 2,289,406; 3,050,818; 3,133,334; 3,613,189; 3,810,282; 3,815,185; 4,139,929; and 4,177,543; and Australian Pat. No. 232,457 (issued Feb. 8, 1961). Conceivably, the insert casket and decorative shell could be interred together, except that difficulties would be encountered in sealing the insert casket while it lies relatively inaccessible within the decorative shell. Removal of the insert casket for the purpose of creating a seal would prove to be awkward and cumbersome.

Of course, the decorative shell itself could be constructed in conventional fashion so as to create a seal, but this would prove to be more expensive since the manufacture of a casket container which combines decorative and sealing functions is significantly more complicated than the manufacture of a casket container which is to be either decorative or sealable.

It will also be appreciated that the need for inserting or removing the insert casket through the top of the decorative shell can be rendered difficult by the presence of the hinged lid of the decorative container. While it may be possible to disassemble the hinges of the lid, as by removing the hinge attaching screws, such an operation is difficult and time consuming and may have to be performed several times.

In many burial caskets now available, the positioning of a deceased within the casket, in the usual posture of repose involves the manipulation of a mattress support by means of an adjustment mechanism at both ends of the casket. It would be desirable to eliminate the cost involved in providing such an arrangement.

It is, therefore, an object of the present invention to minimize or obviate problems of the type discussed above.

It is another object of the invention to provide a novel burial casket arrangement of the type comprising an inner casket and a decorative outer casket or shell.

A further object of the invention is to enable an inner casket to be sealed while disposed within a decorative casket.

An additional object of the invention is to provide a lid hinge which enables a casket lid to be swung open to either side or to be completely removed from the container portion of the casket.

A further object of the invention is to enable the deceased to be properly oriented within a casket without the need for an adjustable mattress support.

SUMMARY OF THE INVENTION

In achieving these objects, the present invention involves a burial casket assembly comprising a decorative casket which includes a decorative container and a decorative cover. An insert casket is insertable within the decorative casket and comprises an insert container and an insert cover. A base member is provided on which the decorative casket is supported. A vault cover is placeable onto the base to encase the decorative casket. The vault cover includes a lower edge portion seatable upon the base.

In an independently significant aspect of the present invention, the insert cover and insert container include cooperative sealing elements, which are urged into sealing relationship in response to displacement of the decorative cover toward the decorative container. This is preferably achieved by arranging a portion of the decorative cover to contact the insert cover in response to displacement of the decorative cover toward the decorative container to urge the sealing elements of the decorative casket together.

In another independently significant aspect of the present invention, a hinge arrangement is provided for a casket cover which enables the cover to be swung open about an axis at either side of the casket, or completely removed from the container.

In yet another independently significant aspect of the present invention, a casket container includes an integrally formed floor which is profiled to eliminate the need for an adjustable mattress support. In this regard, the integrally formed floor includes a downwardly and rearwardly inclined front portion for supporting the back of the deceased, an upwardly and rearwardly inclined midportion for supporting the thighs of the deceased, and a downwardly and rearwardly inclined rear portion for supporting the lower legs of the deceased.

THE DRAWING

The objects and advantages of the invention will become apparent from the following detailed description of a preferred embodiment thereof, in connection with the accompanying drawings in which like numerals designate like elements, and in which.

DETAILED DESCRIPTION OF PREFERRED EMBODIMENTS OF THE INVENTION

Figure 1:
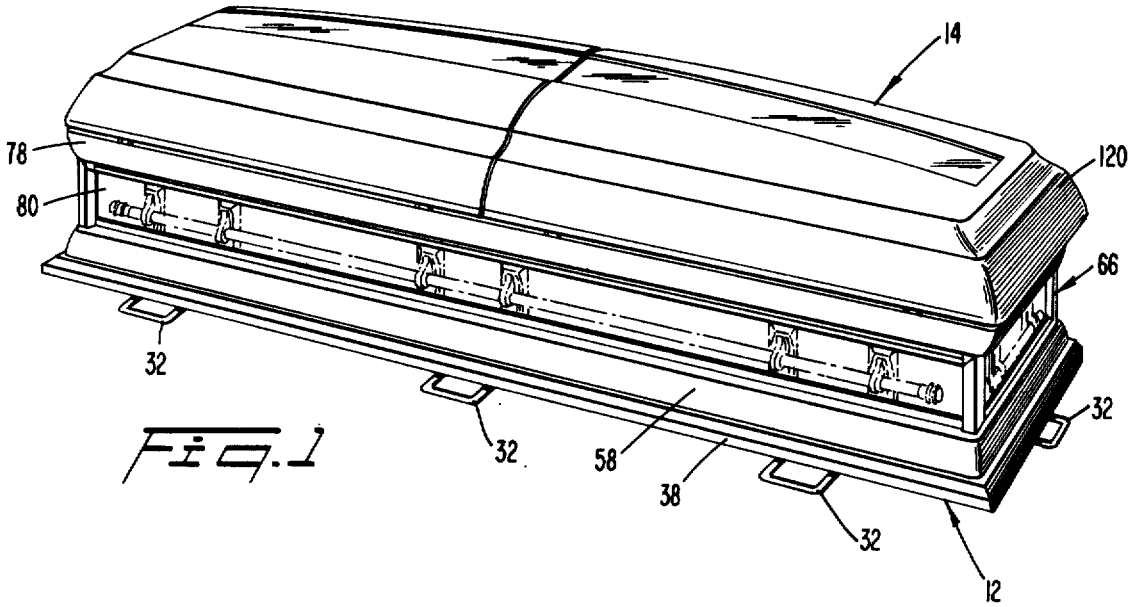
FIG. 1 is a perspective view of a decorative casket seated upon a base in accordance with the present invention.
Figure 2:
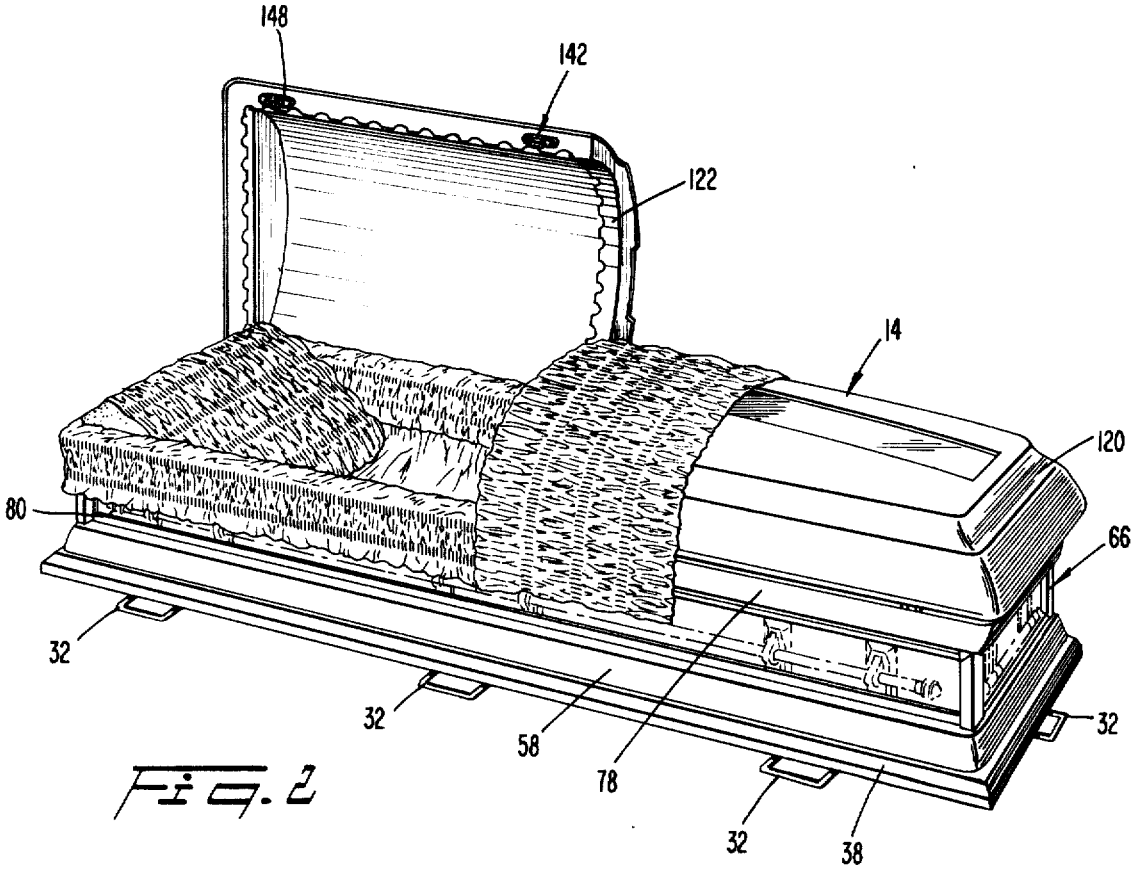
FIG. 2 is a view similar to FIG. 1 with the head portion of the decorative cover in an open position, and the casket upholstery exposed in the viewing condition.
Figure 3:
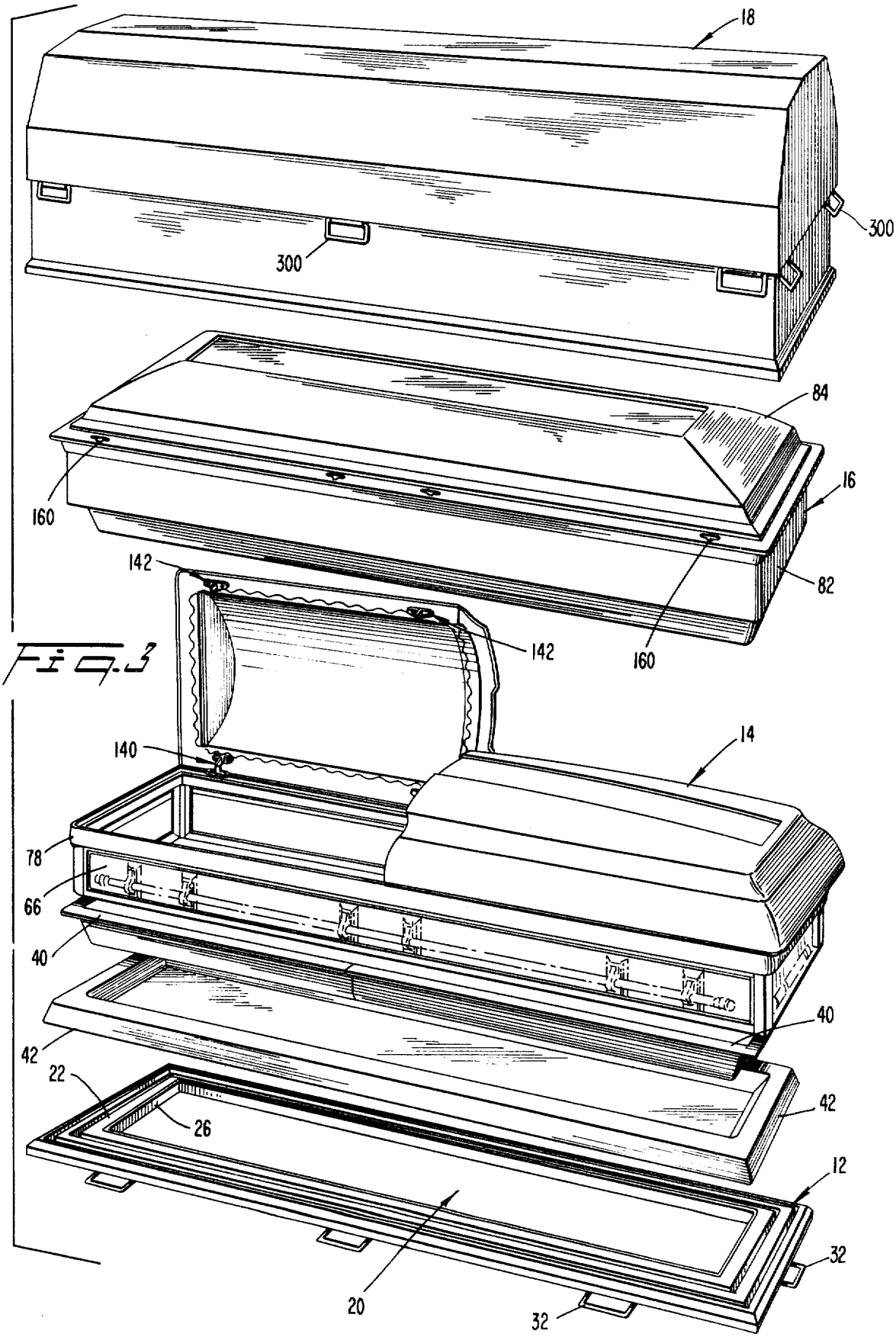
FIG. 3 is an exploded view of an assembly according to the present invention which includes a base, a decorative casket, an insert casket positionable within the decorative casket, and a vault cover placeable onto the base.
Figure 4:
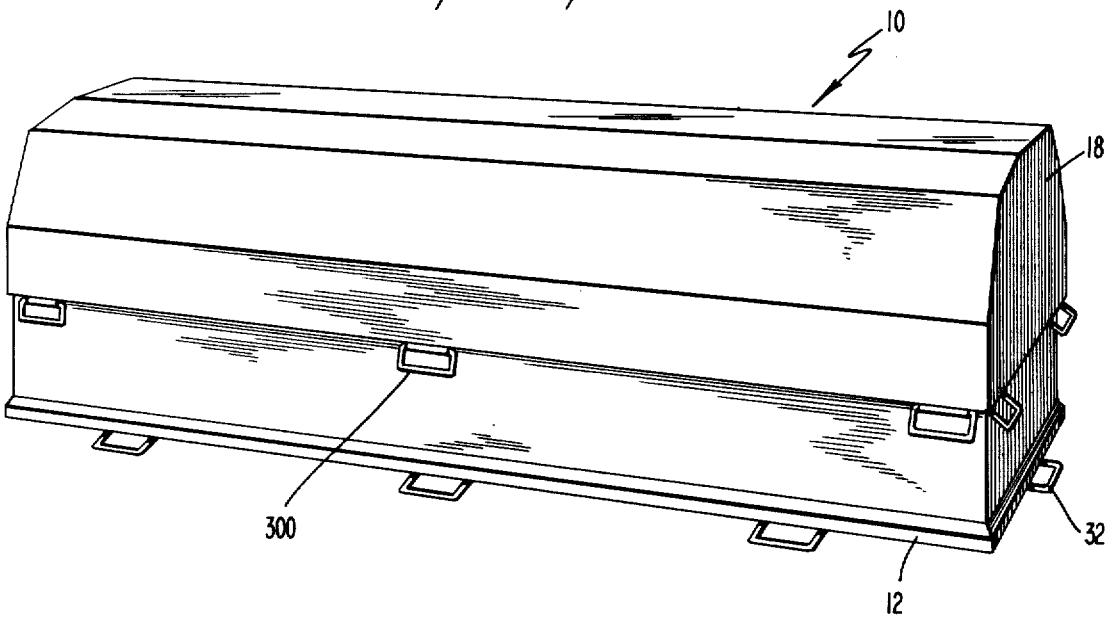
FIG. 4 is a perspective view similar to FIG. 1 in which the vault cover has been placed over the decorative casket.
Figure 5:
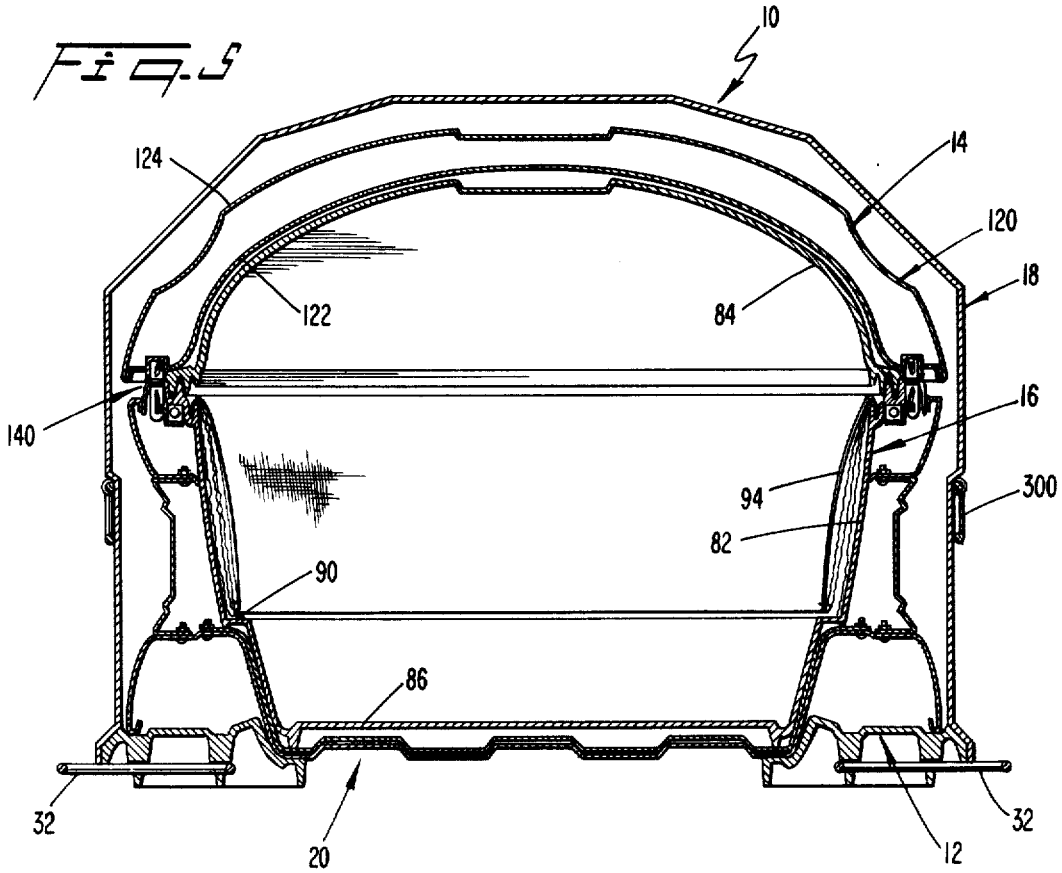
FIG. 5 is a cross-sectional view through the casket assembly with the vault cover in place.
Figure 7:
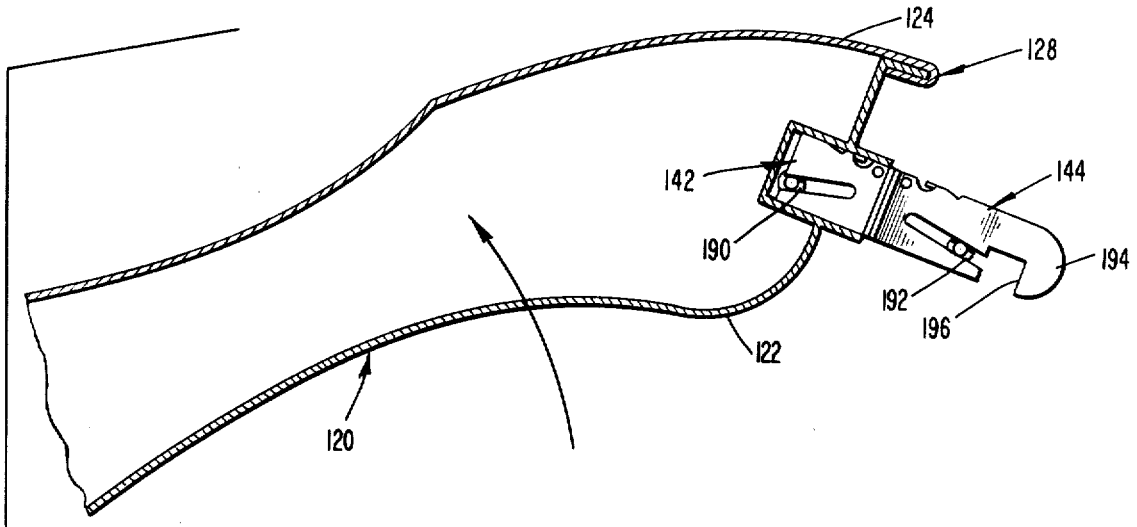
FIG. 7 is a cross-sectional view of a hinge arrangement of the present invention in which the decorative casket cover is in an open condition.
Figure 8:
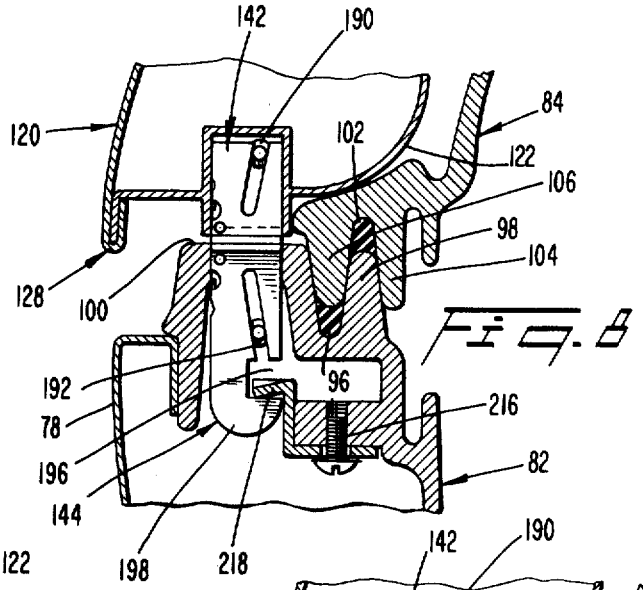
FIG. 8 is a view similar to FIG. 7 in which the decorative cover is in a closed condition.

A preferred burial assembly according to the present invention comprises a base 12, a decorative casket or shell 14 seated on the base, a non-decorative insert or inner casket 16 seated within the decorative casket 14, and a dome-like vault cover 18 seated on the base 12 in overlying relationship to the decorative casket 14.

The base 12 is formed of a suitable material, such as metal, and is of rectangular ring-shaped construction which borders a space 20. A horizontal shelf 22 extends around the inside circumference of the base and is adapted to support the decorative casket. The shelf 22 is bordered on the outside by an upstanding wall 24 which creates a nesting relationship with the floor of the decorative casket.

A plurality of downwardly depending support ribs 26, 28, 30 serve as supports for the base. Slidably mounted within slots in outer ones 28, 30 of the ribs are U-shaped carrying handles 32 which are horizontally extendible and retractible. When the handles are retracted, they engage the wall 34, the latter forming a stop for the handles. An edge rib 36 is provided which extends around all four sides of the base, such rib 36 terminating above the handles 32 and including an inclined support surface 38 against which the vault 18 seats.

The decorative casket 14 includes a container section 35 formed of a plurality of interconnected sheet metal components which, when assembled, create a decorative appearance. A floor of the decorative casket is of two-piece construction, defined by top and bottom floor pieces 40, 42 of sheet metal. The bottom piece 42 includes a rounded peripheral edge portion 44 configured and dimensioned to seat upon the shelf 22 of the base 12. The top piece 40 is configured with a rounded peripheral edge portion 46 which rests within the peripheral edge 44 of the lower piece.

The peripheral edge portions 44, 46 of the upper and lower pieces surround central regions 48, 50 of the upper and lower pieces 40, 42, which regions are corrugated for strength, i.e., alternating ridges and recesses are formed which extend lengthwise along the casket.

Extending from the peripheral edge 44 of the bottom piece 42 are an innermost upright wall 54, a horizontal wall 56, and an outermost upright wall 58.

Extending from the peripheral edge 46 of the top piece 40 are an upright wall 60 extending upwardly against the upright wall 54 of the bottom piece, and a horizontal wall 62 lying upon the horizontal wall 56 of the bottom piece. Fastener bolts 64 or possibly rivets may be employed to interconnect the horizontal walls 60, 62.

The horizontal wall 62 of the upper piece 40 terminates short of the outer edge of horizontal wall 56 of the bottom piece to accommodate mounting of a side wall intermediate plate 66.

The exposed side wall of the decorative casket is formed by the outermost upright wall 58 of the bottom piece 42, the intermediate plate 66 and an upper side wall plate 69. The intermediate plate 66 includes a horizontal lip 68 which seats upon and is fastened by bolts or rivets 70 to the horizontal wall 56 of the bottom piece 42. The upper plate 69 includes a horizontal wall 72 which is fastened to a top horizontal wall 74 of the intermediate plate 66 by bolts 76 or rivets. The exposed portions of the side wall of the decorative casket thus comprise an upright wall 78 of the upper side plate 69, an upright wall 80 of the intermediate side plate 66, and the outermost upright wall 58 of the bottom floor piece 42.

The sections 40, 42, 66, 69 which comprise the decorative casket may be completely fabricated at a manufacturing facility, i.e., formed, sanded, painted, etc., then transported to an assembly station in knockdown form, and then reassembled by the mere addition of the rivets or bolts. This results in a consolidation of space during transport and in less "air" being shipped as would be the case if the caskets were shipped in an assembled condition.

The insert casket 16 includes a container 82 and a cover 84 formed of a suitable material, such as metal, and are preferably each formed of a single piece. The side walls of the insert container are of stepped configuration. In particular, the insert container includes a floor 86 and two upstanding side walls 88 interconnected by two end walls 89, which walls 88, 89 rest upon the decorative container, and bearing against the upright walls 60 of the decorative container. Each side wall 88 is stepped at a level intermediate its height to form a continuous horizontal ledge 90 which may be conveniently widened to serve as an elbow rest for the deceased. Adjacent the upper ends of the side and end walls an upwardly open groove 92 is formed in which decorative upholstery 94 can be fastened in conventional fashion.

The side and end walls also form an upwardly open channel 96 extending around the entire periphery of the insert casket. The channel 96 is formed between an upwardly projecting flange 98 and a peripheral rim 100 of the insert casket.

The cover 84 of the insert casket is adapted to seat upon the container 82 in a sealing fashion. The cover is dome-shaped and includes a generally horizontal peripheral ledge 101. The ledge includes a downwardly open channel 102 defined between a pair of downwardly projecting flanges 104, 106. The channel 102 of the insert cover receives the flange 98 of the insert container, and the channel 96 of the decorative container receives the flange 106 of the decorative cover when the cover closes the container. The flanges 98, 106 and their associated receiver channels 102, 96 have complementary tapers to facilitate the creation of a seal. Gaskets 107 of resilient material may be placed within the channels 102, 96 to promote the creation of such a seal.

The floor 86 of the insert container is formed as an integral part of the container and is profiled in a manner which enables the deceased to be oriented in the traditional manner of repose without the need for the customary adjustable mattress support. That is, the floor 86 includes a front portion 86A which is sloped downwardly from the head to the foot of the casket to support the head and back of the deceased, a midportion 86B which slopes upwardly and rearwardly from the lower end of the front section 86A to support the thighs or upper legs of the deceased, and a rear portion 86C which slopes downwardly from the upper end of the midportion toward the foot of the coffin to support the calves or lower legs of the deceased. In practice, a mattress would be placed upon the floor 86 and the deceased, when placed upon the mattress, would lie in the traditional posture of interment.

The decorative casket includes a decorative lid 120 formed of sheet metal. The lid is of two-piece construction, comprising inner and outer sections 122, 124. The inner section is of curvalinear cross-section and includes an outwardly projecting, generally horizontal shoulder 126 adapted to bear against the top of the ledge 101 of the insert cover 84, as will be later discussed. The outer edges of the inner and outer sections 122, 124 are rolled and welded together at 128. The outer section 124 is shaped in the desired decorative manner, whereas the inner section is of a standard configuration capable of being attached to differently shaped outer sections.

The lid of the decorative casket is adapted to be swung open from either side, or lifted-off completely from the container by means of a hinge arrangement depicted in FIGS. 7 to 11. The hinge arrangement comprises a plurality of hinges 140 on each side of the casket. Each hinge is basically of conventional construction and comprises top and bottom sections 142, 144 which are carried by the decorative lid 12 and the insert container 16, respectively.

The top hinge section 142 includes a pair of flanges 146, the lower ends 148 of which are bent at right angles and fastened to the shoulder 126 of the decorative lid, as by screws 150 for example. The flanges 146 are interconnected by a rear half-wall 152. An upper pivot pin 154 has its ends mounted in the flanges 146.

The lower section 144 also includes a pair of flanges 156 whose ends are bent at right angles to form ears 158. The ears 158, however, are not mounted to the container 35. Rather, the flanges 156 are freely mounted within an opening 160 in the rim of the insert container, the ears 158 forming stop elements which limit travel of the flanges in the opening. The flanges 156 are interconnected by a back half-wall 162. A lower pivot pin 164 has its ends mounted in the flanges 156.

Interconnecting the upper and lower hinge sections 142, 144 is a linkage comprising a first link 170 and a pair of identical second links 172 which straddle the first link 170. All of the links 170, 172 are bent intermediate their ends to form long and short sections which define identical angles. A pivot pin 174 extends through the verticees of all of the links.

The short section 176 of the first link 170 is pivotably mounted on the upper pivot pin 154. The long section 178 of the first link carries a lower floating pin 180 which is parallel to the pivot pins 154, 164 and travels within a pair of aligned slots 188 in the upper flanges 144.

A space 190 is positioned on the upper floating pin to separate the second links 192, and a pair of spacers 192 are positioned on the lower floating pin between the first link 170 on the one hand and the lower flanges 156, respectively, on the other hand.

As described to this point, the hinges are of conventional construction. In accordance with the present invention, the flanges 156 of the lower hinge section 144 include projections 193 which each define a notch 196 adapted to cooperate with a locking element 198 as will be explained hereafter so as to selectively anchor the lower hinge section to the insert container. As will be discussed, the hinges on either side of the casket can be anchored in this fashion to form a pivot about which the casket may be swung open.

Each locking element 198 is arranged for adjustable movement along the respective longitudinal sides of the casket. To this end, the locking element carries a mounting block 200 at one end, the block 200 threadedly receiving an adjustment bolt 202. The bolt 202 is permanently mounted to the insert container for rotation about its own longitudinal axis and is restrained against longitudinal travel. More particularly, a head 204 of the bolt is confined within a pocket 206 of the insert container. The head 204 includes a recess 208 adapted to receive a tool 210 for producing rotation of the bolt to longitudinally displace the locking element 198. The tool is insertable through aligned openings within the insert and decorative containers to enable the hinges to be anchored without removal of the insert casket from the decorative casket.

The locking element preferably comprises an angled piece of sheet metal forming a bottom wall 212 and an upstanding side wall 214. The bottom wall includes a plurality of slots 215 which guidingly receive pins 216 which are affixed to the insert container. The pin-and-slot connection 215, 216 serves to define the forward and backward limits of travel of the locking element 198. In this fashion, it is possible to accurately locate locking cam portions 218 of the locking elements 198. The cam portions comprise projections of the side wall 214 and include front and rear inclined surfaces 220, 222 and a horizontal surface 224 disposed therebetween. With the locking element disposed at one end of its stroke, i.e., the right-hand end of the slots 215 bearing against the pins 216, the cams 218 will lie clear of the notches 196. On the other hand, when the locking element is at the other end of its stroke (FIGS. 9–11) the cams engage the notches.

In order to enable the decorative lid to be lifted completely from the decorative container, the bolts 202 are rotated so as to disengage the cams 218 from the notches 196. By then lifting the decorative lid, the lower hinge sections 144 on both sides of the casket are raised from their associated openings 160 in the insert container. This enables the insert casket to be conveniently inserted and removed from the top of the decorative container.

When it is desired to place the decorative casket lid in a hinged mode, the locking cams 218 on that side of the casket which is to form the rotary axis are placed in a hinge-locking position, whereas the cams on the other side of the casket are placed in an unlocked mode. By then raising the unlocked side of the decorative lid, the locked hinges form a pivot or swing axis.

Figure 6:
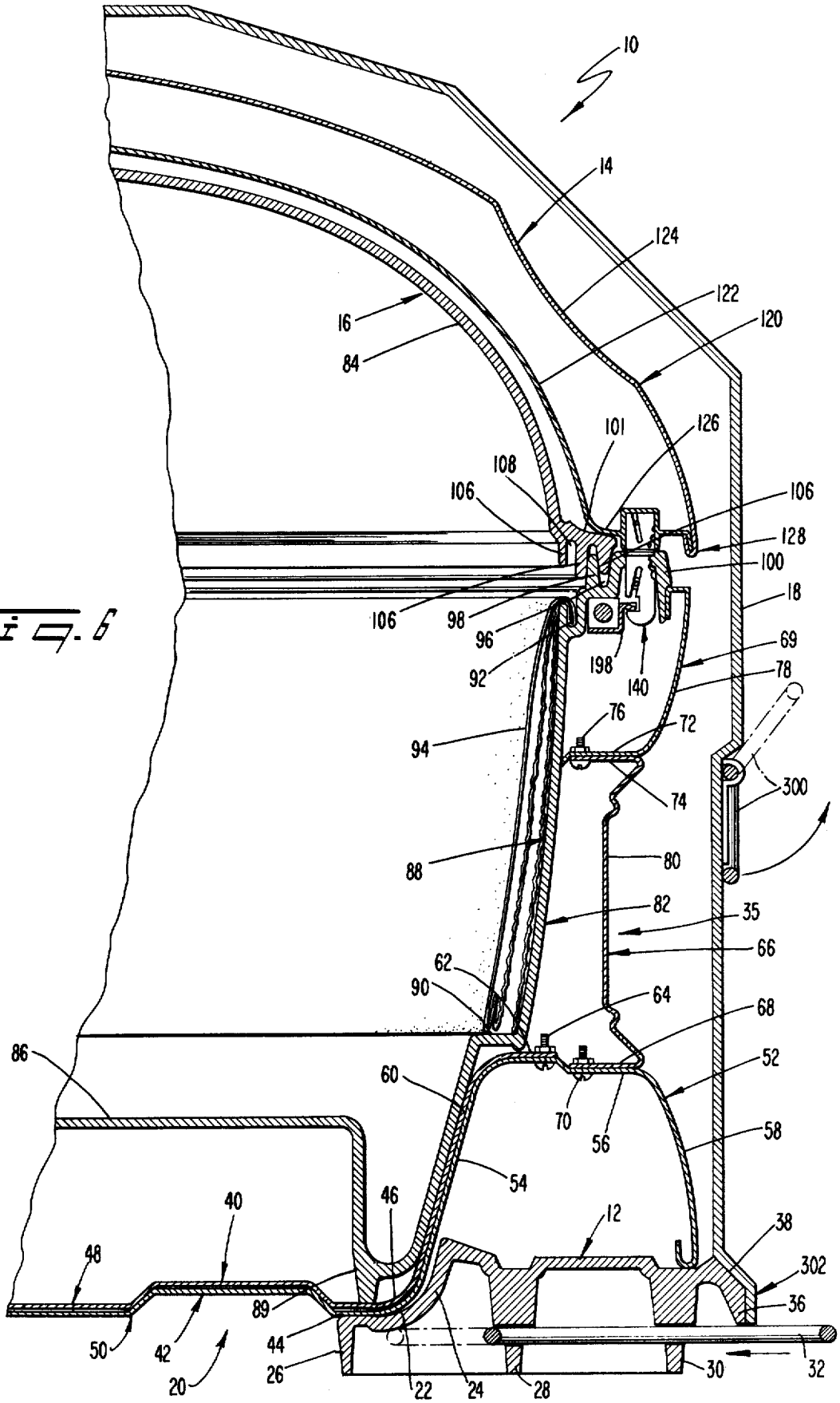
FIG. 6 is an enlarged fragmentary view of the cross-section of FIG. 5.
Figure 6A:
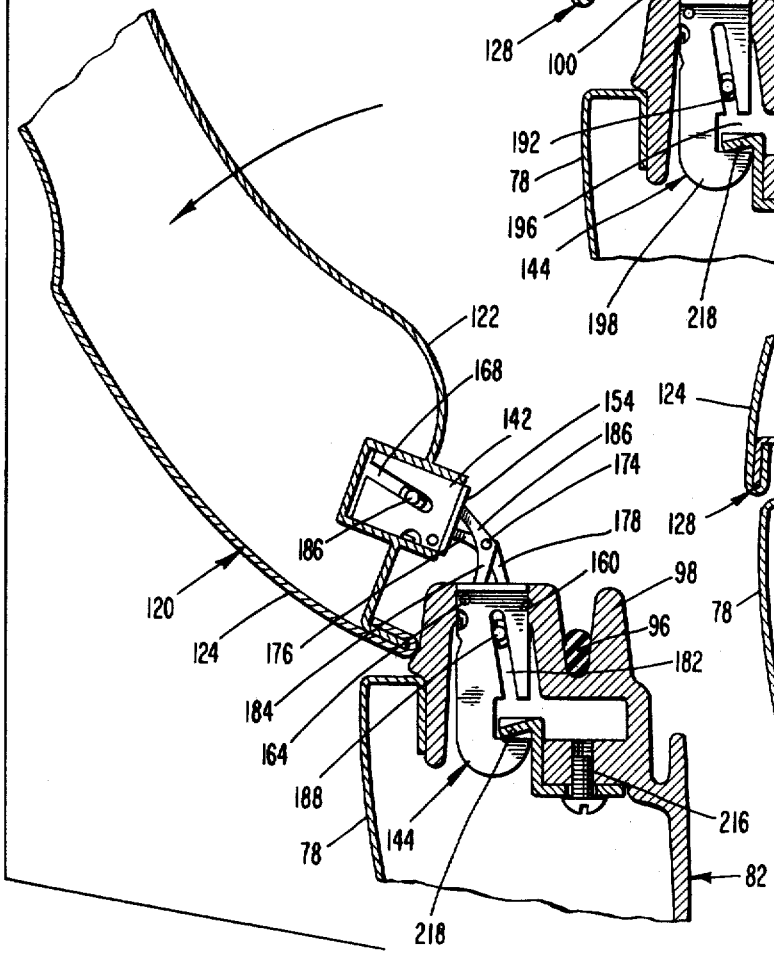
FIG. 6A is a fragmentary view of the cross-section depicted in FIG. 6 illustrating an alternate embodiment of the present invention wherein the lower hinge section is carried by the decorative container, rather than by the insert container.
Figure 6A:
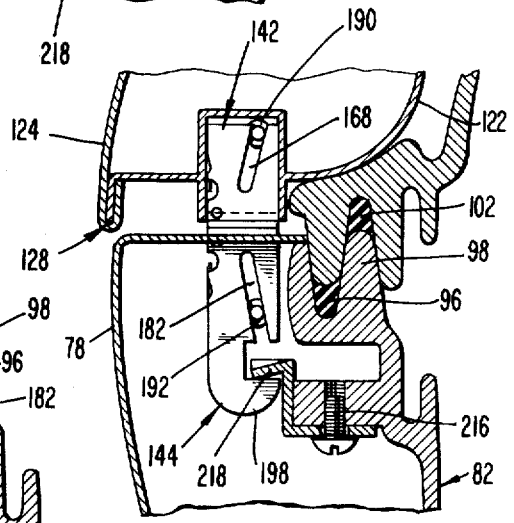
Figure 9:
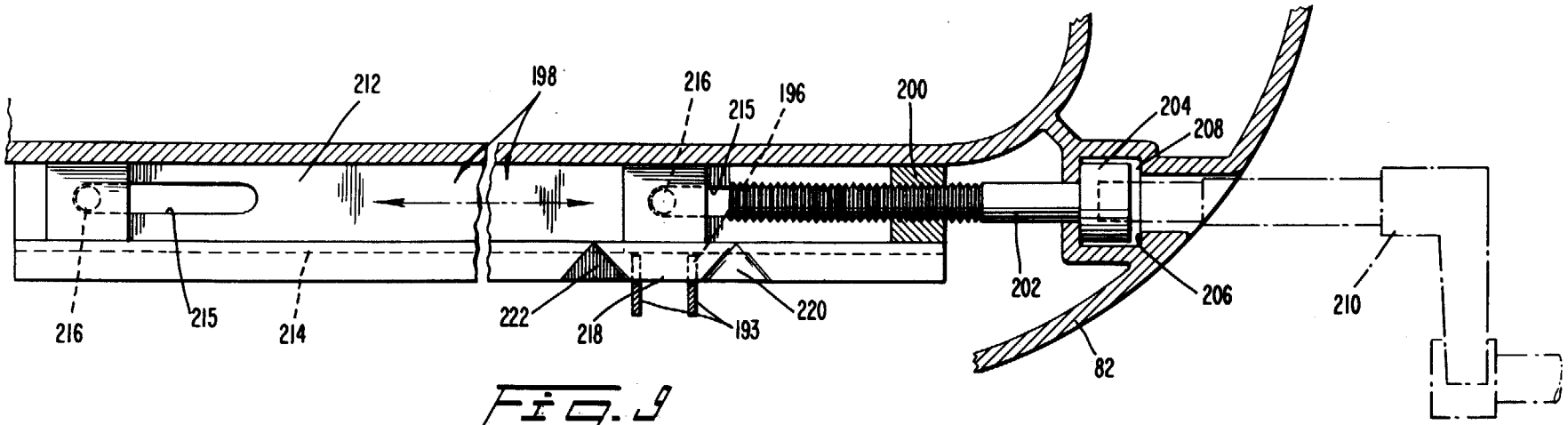
FIG. 9 is a fragmentary longitudinal sectional view taken through the insert casket depicting a mechanism for anchoring the lower hinge sections on one side of the casket.
Figure 10:
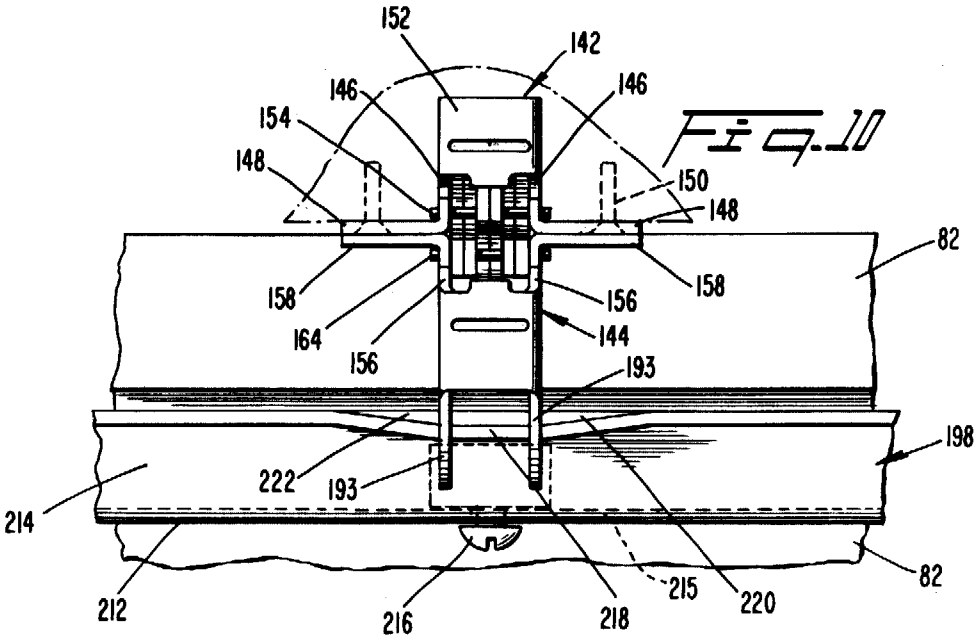
FIG. 10 is a side elevational view of a hinge element according to the present invention.
Figure 11:
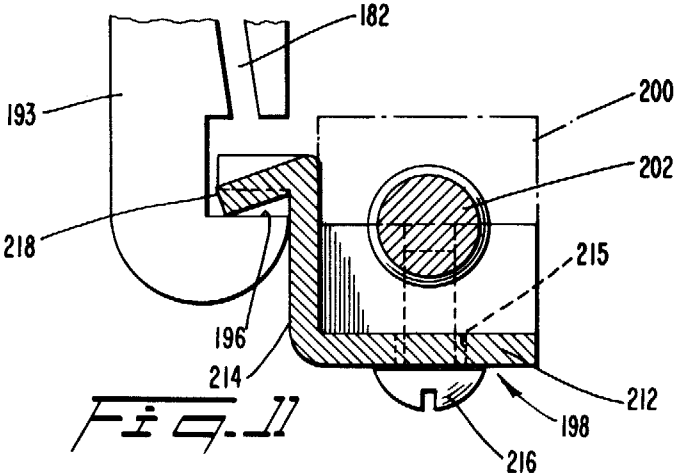
FIG. 11 is a cross-sectional view taken through the hinge anchoring mechanism.
Figure 12:
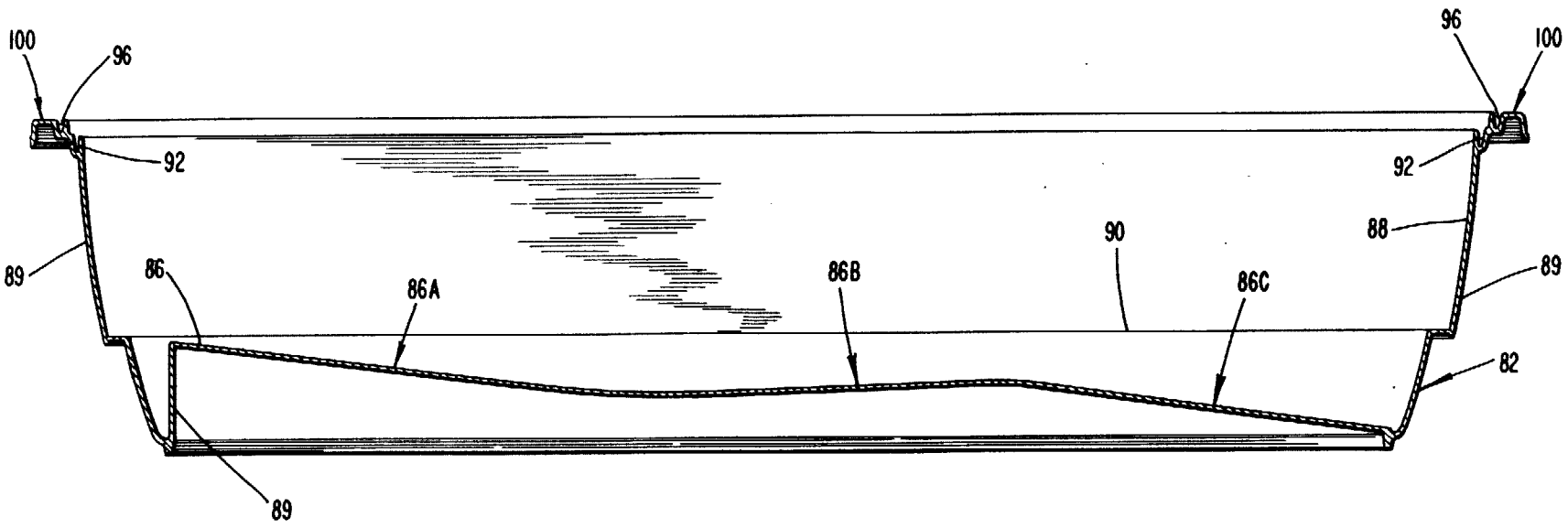
FIG. 12 is a longitudinal sectional view taken through the insert container and illustrating the shape of the floor thereof.

In lieu of locating the lower hinge sections 142 and the locking mechanism 198 in the insert container, such elements can instead be carried by the decorative container (see FIG. 6A).

The vault cover 18 is preferably formed of metal and includes handles 300 by which it can be raised and lowered. A peripheral edge 302 of the vault cover rests upon the inclined surface 38 of the base and terminates above the handles 32 thereof. When placed upon the base, the vault cover 18 encloses the decorative casket.

It will be appreciated that while the insert and decorative caskets are preferably formed of metal, other suitable materials could be employed as well.

It will be further appreciated that the present invention provides a novel casket assembly which effectively allocates the decorative and sealing functions from between two casket members. That is, the insert casket can be manufactured with effective means for creating an air-tight seal around the deceased, whereas the decorative casket can be manufactured to exhibit a highly ornamental appearance. The elimination of the need for combining the sealing and decorative function within a single casket member renders more convenient and economical the fabrication and handling of the individual component parts of the casket assembly. By employing the decorative cover as the means for transmitting sealing forces to the insert casket, the sealing function can be achieved without removal of the insert casket from the decorative casket.

The vault cover enables the decorative casket to be fully encased, and satisfies the requirements of many cemeteries involving the use of vaults. The vault cover rests upon the base so that the entire casket assembly can be carried by means of the handles on the base.

The uniquely profiled floor of the insert casket, which is integrally formed with the insert container, eliminates the need for an adjustable mattress support. That floor is profiled so as to support a deceased in the traditional position of repose.

By employing a decorative casket which is formed of attachable components, which components can be completely manufactured at a fabrication facility, i.e., fabricated, sanded, painted, etc., and then assembled at a remote location merely by the use of rivets or bolts, the cost of transporting the caskets is reduced since the caskets may be transported in a knocked-down condition in which the amount of empty space is reduced.

Although the invention has been described in connection with preferred embodiments thereof, it will be appreciated by those skilled in the art, that additions, modifications, substitutions and deletions not specifically described, may be made without departing from the spirit or scope of the invention as defined in the appended claims.

What is claimed is:

1. A burial casket assembly comprising:

a decorative casket comprising a decorative container and decorative cover, said decorative container having a bottom and sides extending upwardly therefrom, an insert casket insertable within said decorative casket, said insert casket comprising an insert container and an insert cover, said insert container having a bottom and sides extending upwardly therefrom, a base member on which said decorative casket is supported; and a vault cover placeable onto said base to encase said decorative casket, said vault cover including a lower edge portion seatable upon said base.

2. A casket assembly according to claim 1 including means for drawing-down said decorative cover, said decorative cover being engageable with said insert cover for urging the latter into sealing relationship against said insert container in response to said decorative cover being drawn-down.

3. A casket assembly according to claim 2, wherein said decorative cover includes a generally horizontal peripheral shoulder which overlies and bears against a generally horizontal ledge of said insert cover.

4. A casket assembly according to claim 2, wherein said insert container comprises a plurality of upwardly directed flanges which form a first channel, and said insert cover includes a plurality of downwardly projecting flanges which form a second channel, a flange of said insert cover being receivable in said first channel and a flange of said insert container being receivable in said second channel.

5. A casket assembly according to claim 1, wherein said base includes retractible handles.

6. A casket assembly according to claim 1, wherein said decorative container is provided with carrying handles for being lifted while supporting said insert casket therewithin.

7. A casket assembly according to claim 1 including hinge means at both sides of said casket assembly for securing said decorative cover to said decorative container for rotation selectively about an axis at either side of said casket, and enabling said decorative cover to be completely removed from said decorative container.

8. A casket according to claim 5, wherein said hinge means comprises a plurality of hinges at each side of said casket, and common anchoring means at each side of said casket assembly for simultaneously gripping the associated hinges of the respective side whereupon said gripped hinge means forms a pivot axis for said decorative cover.

9. A casket assembly according to claim 8, wherein said gripping means is arranged to draw-down said decorative cover against said decorative container.

10. A casket assembly according to claim 1, wherein said base includes upstanding wall means extending in generally rectangular fashion, the lower portion of said decorative container disposed within and against said wall means and retained thereby.

11. A casket assembly according to claim 1, wherein said vault includes an inclined surface which bears against an inclined surface of said base.

12. A casket assembly according to claim 1, wherein said insert casket includes an integral floor having a rearwardly and downwardly inclined front portion for supporting the back of a deceased, a rearwardly and upwardly inclined midportion for supporting the upper legs of a deceased, and a rearwardly and downwardly inclined rear portion for supporting the lower legs of a deceased.

13. A burial casket assembly comprising:

a decorative casket comprising a decorative container and a decorative cover therefor, an insert casket placeable within said decorative casket and comprising an insert container and an insert cover therefor, said insert cover and insert container including cooperative sealing means, means for displacing said decorative cover toward said decorative container, and means for urging said cooperative sealing means into sealing relationship in response to said displacement of said decorative cover toward said decorative container.

14. A casket assembly according to claim 13, wherein said urging means comprises a portion of said decorative cover arranged to contact said insert cover in response to said displacement of the former.

15. A casket assembly according to claim 14, wherein said urging means comprises a hinge which includes an upper section mounted to said decorative cover and a lower section positionable within one of said insert and decorative containers, and means mounted on said one container for engaging said lower hinge section and displacing said hinge and said decorative cover toward said one container, said decorative cover being arranged to contact said insert cover and urge the latter toward said insert container and bring said cooperative sealing means into sealing relationship.

16. A casket assembly according to claim 13, wherein said insert container comprises a plurality of upwardly directed flanges which form a first channel, and said insert cover includes a plurality of downwardly projecting flanges which form a second channel, a flange of said insert cover being receivable in said first channel and a flange of said insert container being receivable in said second channel.

17. A casket comprising:

a container having first and second parallel side edges extending along two lengthwise sides of said casket, a rigid cover member mountable on said container and extendable widthwise across said container from one side edge to the other of said container, said cover member having first and second parallel side edges which are supported by said first and second side edges of said container when said cover is in a closed condition, first and second hinge means at respective said sides of said casket for:

securing said cover member to said container for rotation of said cover member selectively about an axis at either side edge of said casket and extending parallel to the respective edge, enabling said cover member to be completely removed from said container, and first and second mutually actuable means at respective said sides of said casket for releasably securing the respective hinge means in an axis-defining condition, such that:

with said first hinge means secured, the side edge of said cover disposed opposite said first hinge means is liftable from the associated side edge of said container about an axis defined by said first hinge means, with said second hinge means is secured, the side edge of said cover disposed opposite said second hinge means is liftable from the associated side edge of said container about an axis defined by said second hinge means, with both of said hinge means secured, said cover is immovably attached to said container, and with both of said hinge means released, said cover can be completely removed from said container.

18. A casket according to claim 17, wherein said hinge means at each side of said casket comprises a plurality of spaced hinges, said manually actuable means being arranged to simultaneously grip the associated hinges whereupon the latter form a pivot axis for said cover.

19. A casket assembly according to claim 18, wherein said gripping means is arranged to draw-down said cover toward said container.

20. A casket according to claim 18, wherein said hinge means comprises a plurality of hinge elements each comprising first and second sections pivotably interconnected, said first hinge section mounted to said one of said cover and container, said second hinge section being insertable into said other of said cover and container; said gripping means being selectively engageable with said second hinge section such that with the second hinge sections at one side of said casket being gripped by the associated gripping means, and the second hinge sections at the other side of said casket being free, said casket is swingable about a hinge axis defined at said one side of said casket, and with said second hinge sections at both sides of said casket being free, said cover can be removed from said container.

21. A casket according to claim 20, wherein said first hinge sections are mounted on said cover and said gripping means being mounted on said container.

22. A casket according to claim 20, wherein each gripping means includes cam means engageable with the associated second hinge sections to secure the latter to said other of said cover and container and to draw said cover and container together.

23. A casket according to claim 22, wherein each gripping means comprises a threaded member rotatable about an axis parallel to the longitudinal sides of said casket, said cam means being threadedly secured to said threaded member and secured against rotation relative thereto so as to translate toward and away from a locking relationship with said second hinge sections in response to rotation of said threaded member.

24. A burial casket assembly comprising:

a decorative casket comprising a decorative container and a decorative cover, said decorative container having a bottom and sides extending upwardly therefrom, an insert casket removably placeable within said decorative casket and comprising an insert container and an insert cover, said insert container having a bottom and sides extending upwardly therefrom, means for urging said decorative cover and container together, means for producing a seal between said insert cover and said insert container in response to said urging of said decorative cover and container together, a base on which said decorative casket is supported, and a vault placeable onto said base to encase said decorative casket, said vault cover including a lower edge portion seated on said base, said base including hand-grip means for being manually carried.

25. A burial casket assembly comprising:

a decorative casket comprising a decorative container and a decorative cover therefor, and an insert casket placeable within said decorative casket and comprising an insert container and an insert cover therefor, said insert container including an integrally formed floor which includes a downwardly and rearwardly inclined front portion for supporting the back of a deceased, an upwardly and rearwardly inclined midportion for supporting the upper legs of the deceased, and a downwardly and rearwardly inclined rear portion for supporting the lower legs of the deceased.

* * * * *